US009808819B2

(12) United States Patent
Tada et al.

(10) Patent No.: US 9,808,819 B2
(45) Date of Patent: Nov. 7, 2017

(54) TRIGGER TYPE SPRAYER

(71) Applicant: CANYON CO., LTD., Yamaguchi (JP)

(72) Inventors: Tetsuya Tada, Tokyo (JP); Tomichika Furutani, Sanyo Onoda (JP)

(73) Assignee: CANYON CORPORATION, Sanyo Onoda-shi, Yamaguchi (JP)

( * ) Notice: Subject to any disclaimer, the term of this patent is extended or adjusted under 35 U.S.C. 154(b) by 178 days.

(21) Appl. No.: 14/655,004

(22) PCT Filed: Dec. 24, 2013

(86) PCT No.: PCT/JP2013/007555
§ 371 (c)(1),
(2) Date: Jun. 23, 2015

(87) PCT Pub. No.: WO2014/103288
PCT Pub. Date: Jul. 3, 2014

(65) Prior Publication Data

US 2015/0343472 A1 Dec. 3, 2015

(30) Foreign Application Priority Data

Dec. 29, 2012 (JP) ..... 2012-289195

(51) Int. Cl.
*B05B 11/00* (2006.01)

(52) U.S. Cl.
CPC ..... *B05B 11/3077* (2013.01); *B05B 11/0016* (2013.01); *B05B 11/3009* (2013.01);
(Continued)

(58) Field of Classification Search
CPC ..... B05B 11/3077; B05B 11/0016; B05B 11/3009; B05B 11/3011; B05B 11/3016;
(Continued)

(56) References Cited

U.S. PATENT DOCUMENTS 4,958,754 A * 9/1990 Dennis ..... B05B 11/0016 222/380
5,467,900 A * 11/1995 Maas ..... B05B 11/007 222/341

(Continued)

FOREIGN PATENT DOCUMENTS

JP 4947591 B2 6/2012

OTHER PUBLICATIONS

International Search Report of PCT/JP2013/007555 dated Apr. 15, 2014 and an English translation thereof.

*Primary Examiner* — Frederick C Nicolas
(74) *Attorney, Agent, or Firm* — Muncy, Geissler, Olds & Lowe, P.C.

(57) ABSTRACT

A trigger type sprayer capable of easily performing air vent in a space between a second valve and a first valve, and preventing leakage of liquid in use is provided. The present invention includes a body 11 having a first flow channel 11*a* through which liquid can flow, a second flow channel 11*d* communicating with the first flow channel 11*a*, and a cylindrical cylinder chamber 11*b* communicating with the second flow channel 11*d*; a hollow piston 13 slidably incorporated into the cylinder chamber 11*b*, having a valve seat 13*b* and a hollow portion 13*d* of a second valve 14, and sliding back and forth according to operation of a trigger 12; the second valve 14 incorporated into the hollow portion 13*d* of the hollow piston 13 and positioned at a downstream side; and a first valve 15 incorporated into the cylinder chamber 11*b* and positioned at an upstream side, wherein the first valve 15 is pressed by the second valve 14 so that the first valve 15 is opened.

6 Claims, 12 Drawing Sheets

(52) U.S. Cl.
CPC ..... *B05B 11/3011* (2013.01); *B05B 11/3016* (2013.01); *B05B 11/3023* (2013.01); *B05B 11/3025* (2013.01); *B05B 11/3063* (2013.01); *B05B 11/3066* (2013.01); *B05B 11/3069* (2013.01); *B05B 11/3045* (2013.01)

(58) Field of Classification Search
CPC ..... B05B 11/3023; B05B 11/3025; B05B 11/3063; B05B 11/3066; B05B 11/3069; B05B 11/3045
See application file for complete search history.

(56) References Cited

U.S. PATENT DOCUMENTS 5,513,800 A * 5/1996 Foster ..... B05B 1/3431 222/341
5,590,834 A * 1/1997 Foster ..... B05B 11/0005 239/333
5,716,008 A * 2/1998 Nottingham ..... B05B 11/0016 222/333
6,234,412 B1 * 5/2001 von Schuckmann . B05B 1/3436 222/321.8
6,669,061 B2 * 12/2003 Tada ..... B05B 11/0032 222/153.13
7,775,405 B2 * 8/2010 Sweeton ..... B05B 11/0064 137/540

* cited by examiner

TRIGGER TYPE SPRAYER

TECHNICAL FIELD

The present invention relates to a trigger type sprayer, and in particular to a trigger type sprayer capable of easily performing air vent in a space between a second valve and a first valve.

BACKGROUND ART

Conventionally, as an example of a trigger type sprayer, one disclosed in PTL 1 has been suggested.

This one disclosed in PTL 1 relates to a trigger type liquid spraying device achieving reduction in number of idle triggering actions at the time of initial actuation, or the like, so that air vent in a pump can be easily performed, and capable of in-use smooth liquid spraying operation and uniform spraying, and an outline thereof has such a structure as described below.

That is, in a trigger type liquid spraying device provided with a trigger (I) causing a cylinder (13) to communicate with an intermediate portion of a liquid flow channel provided in a main body (B) and performing pressing-in operation of a plunger (H) sliding in the cylinder (13) and configured so as to spray liquid within a container from a nozzle (J) at a terminal end of the liquid channel according to operation of the trigger (I), a pressure accumulation type delivery valve (53) that brings a delivery valve body (G) which is always biased to an upstream side into pressure contact with a delivery valve seat (40) to define a closed region between the delivery valve (53) and a suction valve (23) is provided within an injection cylinder (12) constituting a portion of the liquid flow channel and having a distal end fitted with the nozzle (J), and an air relief groove (41) causing upstream and downstream flows to communicate with each other is provided in at least one of the delivery valve seat (40) and the delivery valve body (G).

CITATION LIST

Patent Literature

PTL 1: Japanese Patent No. 4947591

SUMMARY OF INVENTION

Technical Problem

However, in the trigger type liquid spraying device disclosed in PTL 1 described above, since either one of the delivery valve seat 40 (corresponding to a valve seat 13*b* of a second valve 14 in the present invention) and a delivery valve body G (corresponding a valve body 14*c* of the second valve 14 in the present invention) is provided with the air relief groove 41 allowing communication of upstream and downstream flows, there is such a problem that liquid may leak through the air relief groove 41 during use even if the air relief groove 41 is minute.

Further, in conventional trigger type spraying devices, including the trigger type liquid spraying device disclosed in PTL 1 described above, it is common that opening and closing a value are performed by moving a valve body in an axial direction.

The present invention has been made in view of these circumstances, and an object of thereof is to provide a trigger type sprayer capable of easily performing air vent in a space between a second valve and a first valve and preventing leakage of liquid during use.

Solution to Problems

The present inventors have conducted intensive research in order to solve the above problem, and, unexpectedly, have found that the above problem can be solved by inclining a valve body of a first valve to open the first valve, and have completed the present invention.

The present invention lies in (1) a trigger type sprayer including: a body having a first flow channel through which liquid can flow, a second flow channel communicating with the first flow channel, and a cylindrical cylinder chamber communicating with the second flow channel; a hollow piston slidably incorporated into the cylinder chamber, having a valve seat and a hollow portion of a second valve, and sliding back and forth according to operation of a trigger; the second valve incorporated into the hollow portion of the hollow piston and positioned at a downstream side; and a first valve incorporated into the cylinder chamber and positioned at an upstream side, wherein the first valve is pressed by the second valve so that the first valve is opened.

The present invention lies in (2) the trigger type sprayer according to the above (1), wherein the second valve has a pressure accumulation function, and is provided with a valve body, a spring, and a bottomed cylindrical case housing the valve body and the spring and attached inside the hollow portion, wherein the first valve is provided with a cylindrical case, a downstream side of which is opened and an upstream side of which is attached in the cylinder chamber, and a valve body positioned at the upstream side of the cylindrical case, wherein the bottomed cylindrical case is slidably incorporated into the cylindrical case, and slides back and forth together with the hollow piston according to operation of the trigger, and wherein the valve body of the first valve is pressed and inclined by a bottom portion of the bottomed cylindrical case so that the first valve is opened.

The present invention lies in (3) the trigger type sprayer according to the above (2), wherein an inclined face is formed on a face on a downstream side of the valve body of the first valve.

The present invention lies in (4) the trigger type sprayer according to the above (2), wherein an inclined face is formed on a face on an upstream side of the bottom portion of the bottomed cylindrical case of the second valve.

The present invention lies in (5) the trigger type sprayer according to the above (2), wherein a protrusion is formed on a face on an upstream side of the bottom portion of the bottomed cylindrical case of the second valve.

The present invention lies in (6) the trigger type sprayer according to the above (2), wherein a cam portion is formed on a face on an upstream side of the bottom portion of the bottomed cylindrical case of the second valve, and a lever provided with a cam portion is attached to a side of the valve body of the first valve so as to extend downstream.

The present invention lies in (7) the trigger type sprayer according to the above (1), wherein the second valve is of a direct pressure type having no pressure accumulation function.

It should be noted that, a configuration made by combining the above (1) to (7) suitably can also be adopted, as long as the configuration suits the object of the present invention.

Advantageous Effects of Invention

The trigger type sprayer of the present invention has the following advantageous effect.

Since the trigger type sprayer of the present invention is a trigger type sprayer including: a body having a first flow channel through which liquid can flow, a second flow channel communicating with the first flow channel, and a cylindrical cylinder chamber communicating with the second flow channel; a hollow piston slidably incorporated into the cylinder chamber, having a valve seat and a hollow portion of a second valve, and sliding back and forth according to operation of a trigger; the second valve incorporated into the hollow piston and positioned at a downstream side; and a first valve incorporated into the cylinder chamber and positioned at an upstream side, wherein the first valve is pressed by the second valve so that the first valve is opened, when the trigger is fully pulled, the bottomed cylindrical case of the second valve slides to an upstream side together with the hollow piston, and the valve body of the first valve to is pressed to be inclined by a bottom portion of the bottomed cylindrical case so that the first valve is opened.

Therefore, air in a space between the second valve and the first valve passes through the first valve, and is discharged into a container, not shown, via the second flow channel and the first flow channel.

In addition, since the second valve is closed during discharge of air in a space between the second valve and the first valve, namely, during air vent, liquid never leaks from the nozzle.

Therefore, by several actions of pulling the trigger (namely, several idle triggering actions), all air vent in a space between the second valve and the first valve can be efficiently performed.

BRIEF DESCRIPTION OF DRAWINGS

FIG. 5(B) being a left side view thereof, FIG. 5(C) being a right side view thereof;

DESCRIPTION OF EMBODIMENTS

A trigger type sprayer 10 according to an embodiment of the present invention will be described below with reference to the drawings.

Figure 1:
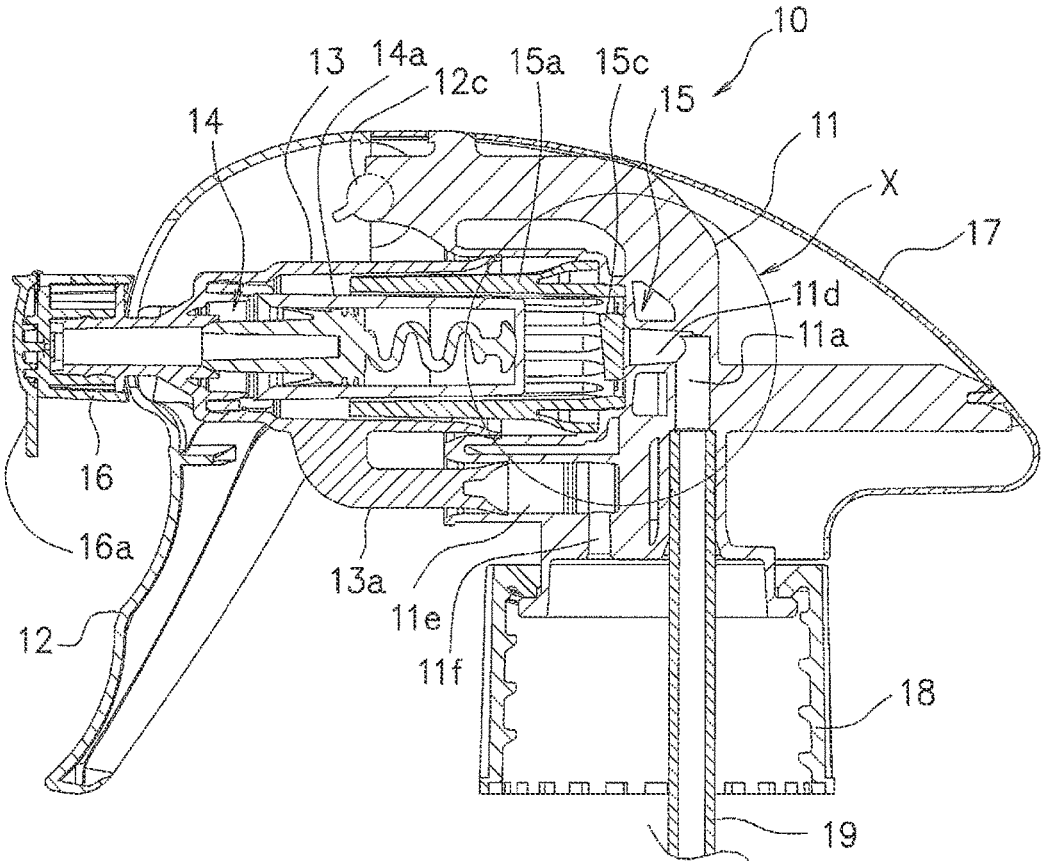
FIG. 1 is a sectional view of an essential part before a trigger of a trigger type sprayer according to an embodiment of the present invention is pulled.
Figure 2:
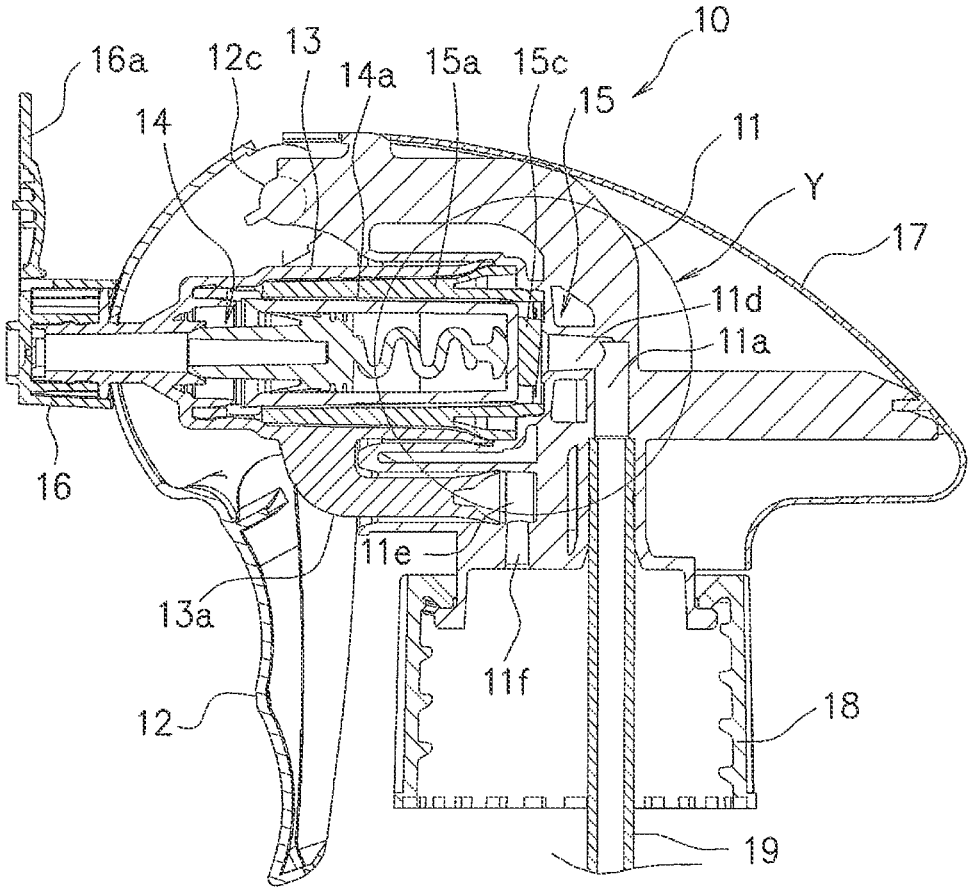
FIG. 2 is a sectional view of the essential part after the trigger of the trigger type sprayer according to the embodiment of the present invention has been fully pulled.
Figure 3:
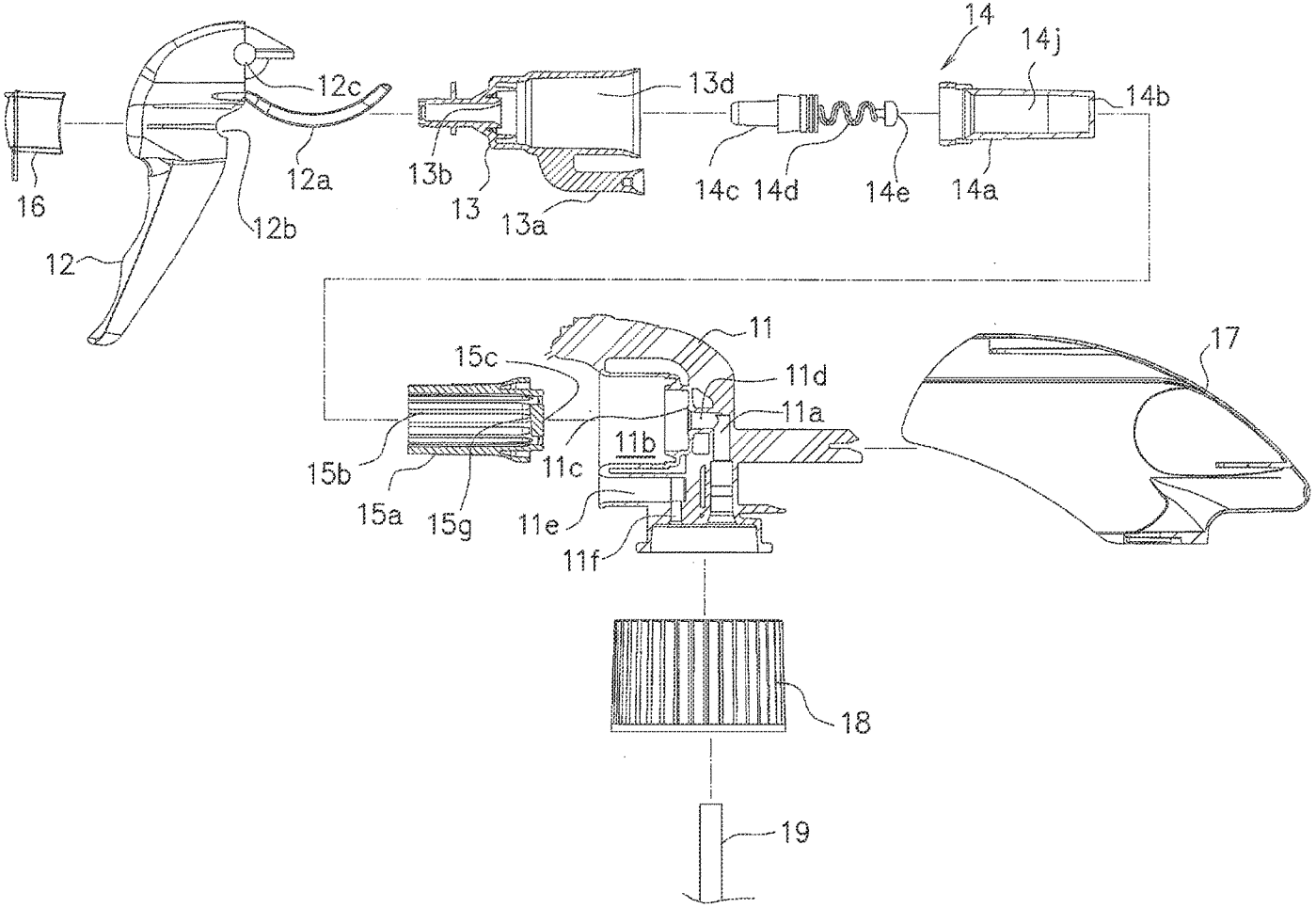
FIG. 3 is an exploded view of the essential part of the trigger type sprayer according to the embodiment of the present invention.

In FIG. 1, FIG. 2 are sectional views of an essential part of the trigger type sprayer 10 made by assembling individual components shown in FIG. 3 (an exploded view of the essential part), FIG. 1 being a sectional view before a trigger 12 is pulled, FIG. 2 being a sectional view after the trigger 12 has been fully pulled. FIG. 1, FIG. 2 both omitting a container to which a cap 18 is attached.

That is, a container containing liquid is not shown.

The trigger type sprayer 10 has a nozzle 16 having a nozzle cover 16*a*, a hollow piston 13, a bottomed cylindrical case 14*a*, a valve body 14*c* of a second valve 14 and a spring 14*d* biasing the valve body constituting the second valve, a cylindrical case 15*a* constituting a first valve 15, a body 11, a cover 17 of the body 11, the cap 18, and a suction tube 19.

The cap 18, as shown in FIG. 1, FIG. 2, has an upper portion attached to a lower portion of the body 11 in an airtight manner, and this cap 18 is attached to the container containing liquid, not shown, by screwing or the like.

Figure 4:
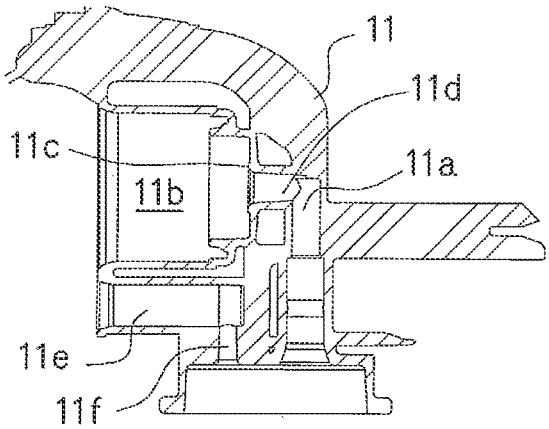
FIG. 4 is a sectional view of a body shown in FIG. 3.

The body 11, as shown in FIG. 4, is provided with a vertical first flow channel portion 11*a*, a cylinder chamber 11*b*, a valve seat 11*c* of the first valve, a horizontal second flow channel portion 11*d*, a secondary cylinder chamber 11*e*, and an air flow channel 11*f*.

The trigger 12, as shown in FIG. 3, is provided with a return plate spring 12*a*, and a fitting portion 12*b* fitted with a pair of diametrical support shafts 13*c* of the hollow piston 13 described later, and, as shown in FIG. 1, FIG. 2, it is pivotally attached to the body 11 via a hinge portion 12*c*.

Figure 5A:
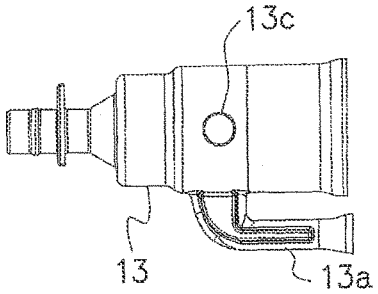
FIGS. 5(A) to 5(C) show a hollow piston shown in FIG. 3, FIG. 5(A) being a front view of the hollow piston.
Figure 5B:
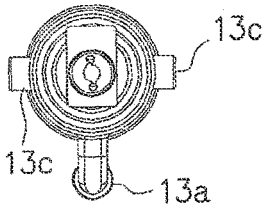
Figure 5C:
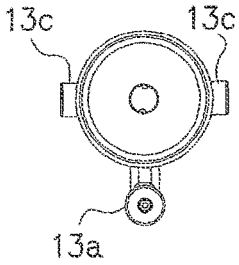

The hollow piston 13, as shown in FIG. 3, FIG. 5, is provided with a negative pressure relief piston 13*a*, a valve seat 13*b* of the second valve, the pair of diametrical support shafts 13*c*, and a hollow portion 13*d*.

Further, the hollow piston 13 and the negative pressure relief piston 13*a* are slidably fitted in the cylinder chamber 11*b* and the secondary cylinder chamber 11*e*, respectively.

The second valve 14, as shown in FIG. 1, FIG. 2 and FIG. 3, is provided with the bottomed cylindrical case 14*a*, the valve body 14*c* of the second valve, the spring 14*d* biasing the valve body 14*c*, and an abutting portion 14*e*, the valve body 14*c* of the second valve, the spring 14*d* biasing the valve body 14*c*, and the abutting portion 14*e* are incorporated into a hollow portion 14*j* of the bottomed cylindrical case 14*a*, and the valve body 14*c* biased by the spring 14*d* abuts on the valve seat 13*b* of the second valve 14 formed in the hollow piston 13.

Therefore, the second valve 14 has a pressure accumulation function.

Further, the bottomed cylindrical case 14*a* incorporated with these members has a downstream side attached inside the hollow portion 13*d* of the hollow piston 13.

Figures 6A, 6B, 6C, 6D:
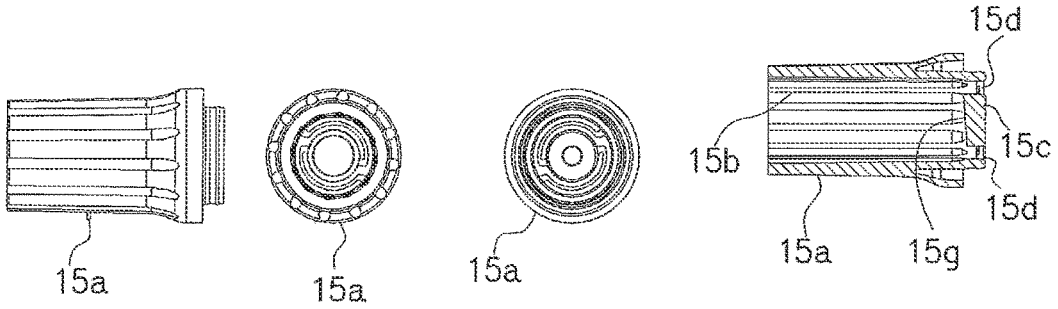
FIGS. 6(A) to 6(D) show a cylindrical case of a first valve shown in FIG. 3, FIG. 6(A) being a front view of the cylindrical case, FIG. 6(B) being a left side view thereof, FIG. 6(C) being a right side view thereof, FIG. 6(D) being an axial sectional view thereof.

Now, the cylindrical case 15*a* constituting the first valve 15, as shown in FIG. 6(A). FIG. 6(B), FIG. 6(C), is provided with a plurality of axial grooves 15*b* formed in an inner face of the cylindrical case 15*a*, a valve body 15*c* of the first valve, and a plurality of plate spring portions 15*d* biasing the valve body 15*c*.

Further, the cylindrical case 15*a* has a downstream side opened and an upstream side attached inside the cylinder chamber 11*b*, and has the valve body 15*c* supported on the inner face at the upstream side via the plurality of plate spring portions 15*d*.

Further, as shown in FIG. 1, FIG. 2, the bottomed cylindrical case 14*a* having the hollow portion 14*j* incorporated with the valve body 14*c* of the second valve, the spring 14*d* biasing the valve body 14*c*, and the abutting portion 14*e* is inserted so as to be capable of sliding back and forth in the cylindrical case 15*a* constituting the first valve 15.

In addition, the cylindrical case 15*a* inserted with the bottomed cylindrical case 14*a* is attached at the upstream side thereof to the inside of the cylinder chamber 11*b* of the body 11.

Figure 7A:
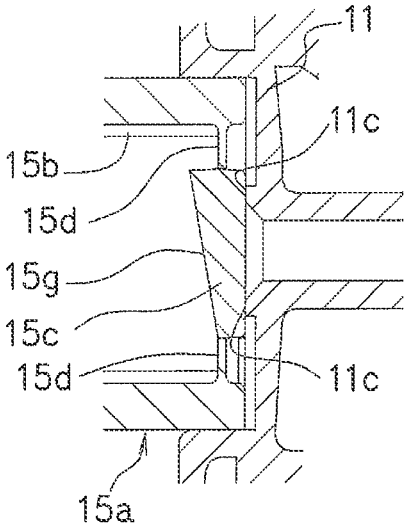
FIGS. 7(A) and 7(B) show an essential part of the first valve shown in FIG. 1 in an enlarged manner, FIG. 7(A) being an enlarged sectional view of the essential part including a valve body, FIG. 7(B) being a left side view thereof.
Figure 7B:
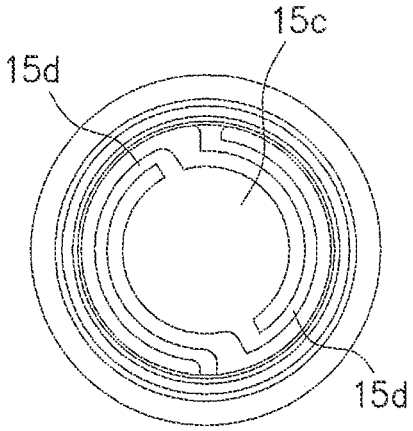

As shown in FIG. 7(A), at an end portion on an upstream side of the cylindrical case 15*a*, the valve body 15*c* is supported by the plurality of plate spring portions 15*d* biasing the valve body 15*c*, and the valve body 15*c* and the plate spring portions 15*d* are coupled to each other, as shown in FIG. 7(B).

Further, the valve body 15*c* is formed with an inclined face 15*g* on a face on the downstream side.

Further, as described later, the valve body 15*c* can incline against a biasing force of the plate spring portions 15*d* by a pressing force from a bottom portion 14*b* of the bottomed cylindrical case 14*a*, and the valve body 15*c* can return to an original position according to the biasing force of the plate spring portions 15*d* when the pressing force from the bottom portion 14*b* of the bottom cylindrical case 14*a* is lost.

Further, as shown in FIG. 7(A), when the pressing force from the bottom portion 14*b* of the bottomed cylindrical case 14*a* is lost, a face on the upstream side of the valve body 15*c* abuts on the valve seat 11*c* of the first valve 15 according to the biasing force of the plate spring portions 15*d*.

Figure 8A:
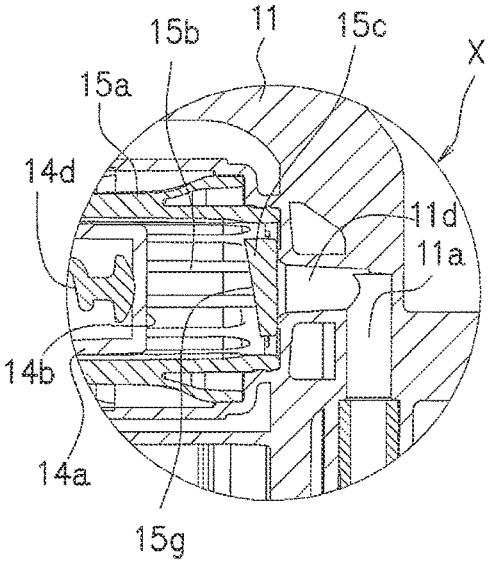
FIGS. 8(A) and 8(B) show opened and closed states of the first valve in the trigger type sprayer according to the embodiment of the present invention, FIG. 8(A) being an enlarged view of the inside of a circle X in FIG. 1, showing a state before the trigger is pulled, FIG. 8(B) being an enlarged view of the inside of a circle Y in FIG. 2, showing a state after the trigger has been fully pulled.
Figure 8B:
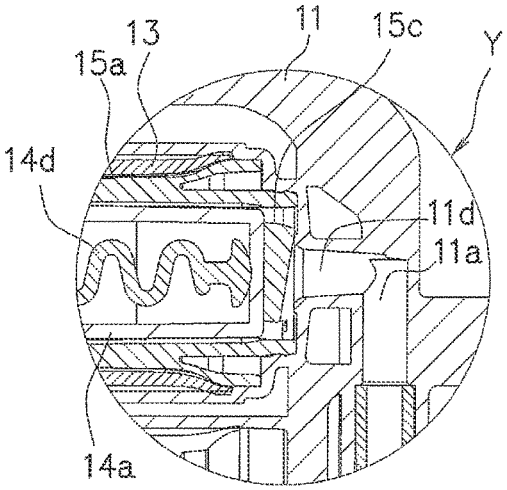

FIGS. 8(A) and 8(B) show opened and closed states of the first valve 15 in the trigger type sprayer 10 according to the embodiment of the present invention. FIG. 8(A) being an enlarged view of the inside of a circle X in FIG. 1, showing a state before the trigger 12 is pulled, FIG. 8(B) being an enlarged view of the inside of a circle Y in FIG. 2, showing a state after the trigger 12 has been fully pulled.

As shown in FIG. 8(A), in the state before the trigger 12 is fully pulled, the valve body 15*c* abuts on the valve sheet 11*c* of the first valve 15 according to the biasing force of the plate spring portions 15*d* so that the first valve 15 is closed.

As shown in FIG. 8(B), in the state after the trigger 12 has been pulled, the inclined face 15*g* of the valve body 15*c* is pressed by the bottom portion 14*b* of the bottomed cylindrical case 14*a*, and the valve body 15*c* is inclined against the biasing force of the plate spring portions 15*d*, so that a gap occurs between the valve body 15*c* and the valve seat 11*c* of the first valve 15 and the first valve 15 is opened.

In this regard, in order to incline the valve body 15*c* by pressing a portion thereof, such a soft material as to cause the valve body itself to deflect easily is not suitable, and a certain degree of rigidity is required.

Next, an air vent action of the trigger type sprayer 10 according to the embodiment of the present invention will be described below.

In an initial state before the air vent action is performed, namely, in the state before the trigger 12 is pulled, as shown in FIG. 1, specifically, as shown in FIG. 7(A). FIG. 8(A), the valve body 15*c* of the first valve 15 abuts on the valve seat 11*c* of the first valve 15 according to the biasing force of the plate spring portions 15*d* so that the first valve 15 is closed.

Subsequently, when the trigger 12 is fully pulled, as shown in FIG. 2, specifically, as shown in FIG. 8(B), the hollow piston 13 slides to the upstream side in the cylinder chamber 11*b* of the body 11. At this time, the bottomed cylindrical case 14*a* also slides to the upstream side together with the hollow piston 13.

Further, when the bottomed cylindrical case 14*a* slides to the upstream side, the bottom portion 14*b* of the bottomed cylindrical case 14*a* presses a higher portion (so-called apex portion) of the inclined face 15*g* of the valve body 15*c*.

That is, the bottom portion 14*b* of the bottomed cylindrical case 14*a* presses a portion of the valve body 15*c* corresponding to the outside of the valve seat 11*c*.

This causes the valve body 15*c* to incline against the biasing force of the plate spring portions 15*d*, so that a gap occurs between the valve body 15*c* and the valve seat 11*c* of the first valve and the first valve 15 is opened.

Therefore, air in a space between the second valve 14 and the first valve 15 passes through the first valve 15, and is discharged into a container, not shown, via the second flow channel 11*d* and the first flow channel 11*a*.

Subsequently, in this state, when a finger is released from the trigger 12, the trigger 12 returns to the initial state before the air vent action is performed, namely, as shown in FIG. 1, according to the biasing force of the return plate spring 12*a* of the trigger 12, and the hollow piston 13 slides to the downstream side.

At this time, the bottomed cylindrical case 14*a* also slides to the downstream side together with the hollow piston 13.

A state where the bottomed cylindrical case 14*a* has been slid to the downstream side is shown in FIG. 1 and specifically, in FIG. 7(A), FIG. 8(A).

As shown in FIG. 7(A), FIG. 8(A), when the bottomed cylindrical case 14*a* slides to the downstream side, so that the pressing force to the valve body 15*c* from the bottom portion 14*b* of the bottomed cylindrical case 14*a* is lost, a face on the upstream side of the valve body 15*c* abuts on the valve sheet 11*c* of the first valve 15 according to the biasing force of the plate spring portions 15*d* and the first valve 15 is closed.

The trigger type sprayer 10 according to the embodiment of the present invention has the following advantageous effect.

The trigger type sprayer 10 includes a body 11 having a first flow channel 11*a* through which liquid can flow, a second flow channel 11*d* communicating with the first flow channel 11*a*, and a cylindrical cylinder chamber 11*b* communicating with the second flow channel 11*d*; a hollow piston 13 slidably incorporated into the cylinder chamber 11*b*, having a valve seat 13*b* and a hollow portion 13*d* of a second valve 14, and sliding back and forth according to operation of a trigger 12; the second valve 14 incorporated into the hollow piston 13 and positioned at a downstream side; and a first valve 15 incorporated into the cylinder chamber 11*b* and positioned at an upstream side, wherein the valve body 15*c* of the first valve 15 is pressed by the bottom portion 14*b* of the bottomed cylindrical case 14*a* of the second valve 14 so that the first valve 15 is opened.

Further, when the trigger 12 is pulled, the bottomed cylindrical case 14*a* of the second valve 14 slides to the upstream side together with the hollow piston 13, and the valve body 15*c* of the first valve 15 is pressed to be inclined by the bottom portion 14*b* of the bottomed cylindrical case 14*a* so that the first valve 15 is opened.

Therefore, air in a space between the second valve 14 and the first valve 15 passes through the first valve 15, and is discharged into a container, not shown, via the second flow channel 11*d* and the first flow channel 11*a*.

Further, since the second valve 14 is closed during discharge of air in a space between the second valve 14 and the first valve 15, namely, during air vent, liquid never leak from the nozzle 16.

Therefore, by several actions of fully pulling the trigger 12 (namely, several idle triggering actions), air vent in a space between the second valve 14 and the first valve 15 can be efficiently performed.

Further, after air vent is completed by performing the above-described several idle triggering actions of the trigger type sprayer 10 according to the embodiment of the present invention, normal delivery or spray of liquid is performed by subsequently performing the action of pulling the trigger 12.

It should be noted that the liquid sucked up from the container according to opening of the first valve 15 transfers to the second valve 14 side through the plurality of axial grooves 15*b* formed in the inner face of the cylindrical case 15*a*.

Next, first to fourth variations of the trigger type sprayer 10 according to an embodiment of the present invention will be described with reference to FIG. 9 to FIG. 12 schematically showing their actuations.

It should be noted that the cylindrical case 15*a* and/or the plate spring portion 15*d* of the first valve 15 are omitted for descriptive purposes.

Figure 9A:
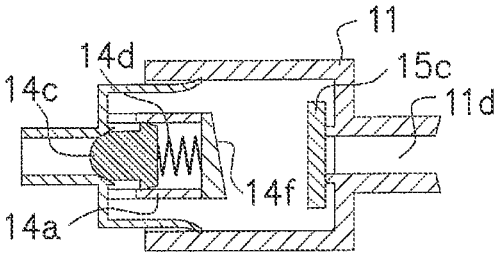
FIGS. 9(A) and 9(B) schematically show actuation of a first variation of the trigger type sprayer according to the embodiment of the present invention, FIG. 9(A) showing a state before the trigger is pulled, FIG. 9(B) showing a state after the trigger has been fully pulled.
Figure 9B:
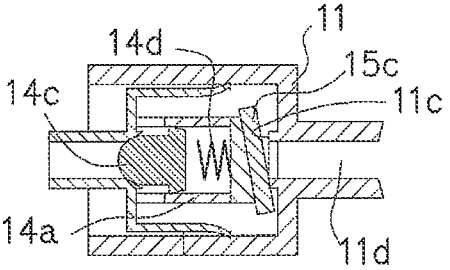

FIGS. 9(A) and 9(B) schematically show the actuation of the first variation, FIG. 9(A) showing a state before the trigger 12 is pulled, FIG. 9(B) showing a state after the trigger 12 has been fully pulled.

In the first variation shown in FIGS. 9(A) and 9(B), a face on the upstream side of the bottom portion 14*b* of the bottomed cylinder case 14*a* of the second valve 14 is formed with an inclined face 14*f*.

Therefore, when the trigger 12 is fully pulled, the bottomed cylindrical case 14*a* slides to the upstream side in the cylinder chamber 11*b* of the body 11, and the inclined face 14*f* (higher portion) on the face on the upstream side of the bottom portion 14*b* of the bottomed cylindrical case 14*a* presses the valve body 15*c*.

That is, the higher portion of the inclined face 14*f* of the bottom portion 14*b* of the bottomed cylindrical case 14*a* presses a portion of the valve body 15*c* corresponding to the outside of the valve seat 11*c*.

Thereby, the valve body 15*c* is inclined.

Then, as shown in FIG. 9(B), a gap occurs between the valve body 15*c* and the valve seat 11*c* of the first valve 15, the first valve 15 is opened, and air is discharged into a container, not shown, via the second flow channel 11*d* and the first flow channel 11*a*.

Further, when the finger is released from the trigger 12, as shown in FIG. 9(A), an original state, namely, a state in which the valve body 15*c* abuts on the valve seat 11*c* according to a restorative force of a spring, not shown, is restored so that the first valve 15 is closed.

Figure 10A:
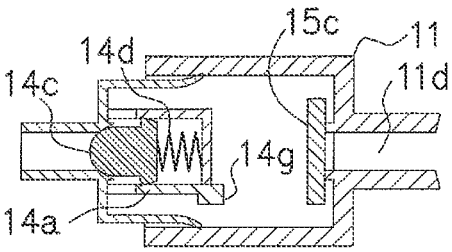
FIGS. 10(A) and 10(B) schematically show actuation of a second variation of the trigger type sprayer according to the embodiment of the present invention, FIG. 10(A) showing a state before the trigger is pulled, FIG. 10(B) showing a state after the trigger has been fully pulled.
Figure 10B:
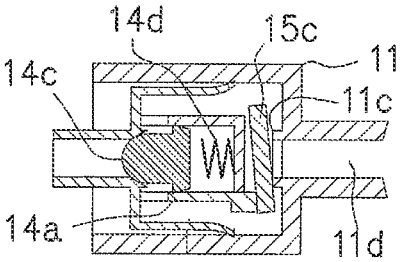

FIGS. 10(A) and 10(B) schematically show shows the actuation of the second variation, FIG. 10(A) showing a state before the trigger 12 is pulled, FIG. 10(B) showing a state after the trigger 12 has been fully pulled.

In the second variation shown in FIG. 10, a protrusion 14*g* is formed on the face on the upstream side of the bottom portion 14*b* of the bottomed cylindrical case 14*a* of the second valve 14.

Therefore, when the trigger 12 is fully pulled, the bottomed cylindrical case 14*a* slides to the upstream side in the cylinder chamber 11*b* of the body 11, and the protrusion 14*g* formed on the face on the upstream side of the bottom portion 14*b* of the bottomed cylindrical case 14*a* presses the valve body 15*c*.

That is, the protrusion 14*g* presses a portion of the valve body 15*c* corresponding to the outside of the valve seat 11*c*. Thereby, this valve body 15*c* is inclined.

Then, as shown in FIG. 10(B), a gap occurs between the valve body 15*c* and the valve seat 11*c* of the first valve 15, the first valve 15 is opened, and air is discharged into a container, not shown, via the second flow channel 11*d* and the first flow channel 11*a*.

Further, when the finger is released from the trigger 12, as shown in FIG. 10(A), an original state, namely, a state in which the valve body 15*c* abuts on the valve seat 11*c* according to a restorative force of a spring, not shown, is restored so that the first valve 15 is closed.

Figure 11A:
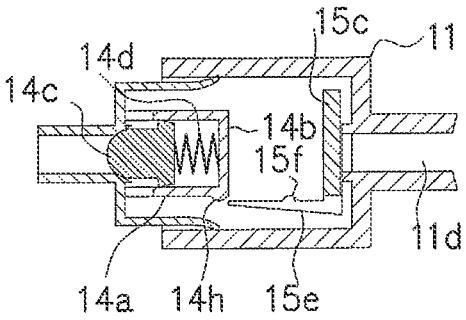
FIGS. 11(A) and 11(B) schematically show actuation of a third variation of the trigger type sprayer according to the embodiment of the present invention, FIG. 11(A) showing a state before the trigger is pulled, FIG. 11(B) showing a state after the trigger has been fully pulled.
Figure 11B:
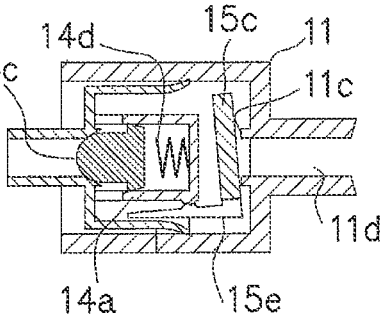

FIGS. 11(A) and 11(B) schematically show the actuation of the third variation, FIG. 11(A) showing a state before the trigger 12 is pulled, FIG. 11(B) showing a state after the trigger 12 has been fully pulled.

In the third variation shown in FIGS. 11(A) and 11(B), a cam portion 14*h* is formed on the face on the upstream side of the bottom portion 14*b* of the bottomed cylindrical case 14*a* of the second valve 14, and a lever 15*e* provided with a cam portion 15*f* is attached to a side portion of the valve body 15*c* of the first valve 15 so as to extend downstream in a raised manner.

Therefore, when the trigger 12 is fully pulled, the bottomed cylindrical case 14*a* slides to the upstream side in the cylinder chamber 11*b* of the body 11, and a state shown in FIG. 11(B) in which the cam portion 14*h* on the bottomed cylindrical case 14*a* side and the cam portion 15*f* on the lever 15*e* side abut on each other is obtained.

In this state, the valve body 15*c* of the first valve 15 is inclined via the lever 15*e*.

Then, as shown in FIG. 11(B), a gap occurs between the valve body 15*c* and the valve seat 11*c* of the first valve 15, the first valve 15 is opened, and air is discharged into a container, not shown, via the second flow channel 11*d* and the first flow channel 11*a*.

Further, when the finger is released from the trigger 12, as shown in FIG. 11(A), an original state, namely, a state in which the abutting state between the cam portion 14*h* on the bottomed cylindrical case 14*a* side and the cam portion 15*f* on the lever 15*e* side have been released, and a state in which has caused the valve body 15*c* has abutted on the valve seat 11*c* according to a restorative force of a spring, not shown, is restored, so that the first valve 15 is closed.

Figure 12A:
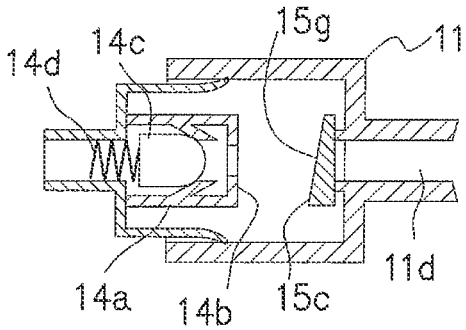
FIGS. 12(A) and 12(B) schematically show actuation of a fourth variation where a means for inclining a valve body of the first valve of the present invention is applied to a direct pressure type trigger type sprayer, FIG. 12(A) showing a state before the trigger is pulled, FIG. 12(B) being a state after the trigger has been fully pulled.
Figure 12B:
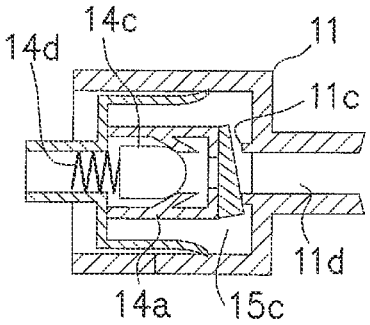

FIGS. 12(A) and 12(B) schematically show the actuation of the fourth variation, FIG. 12(A) showing a state before the trigger 12 is pulled. FIG. 12(B) showing a state after the trigger 12 is fully pulled.

In the fourth variation shown in FIGS. 12(A) and 12(B), the second valve 14 is of a direct pressure type having no pressure accumulation function, and the inclined face 15*g* is formed on the face on the downstream side of the valve body 15*c* of the first valve 15.

Therefore, when the trigger 12 is fully pulled, the bottomed cylindrical case 14*a* slides to the upstream side in the cylinder chamber 11*b* of the body 11, and the bottom portion 14*b* of the bottomed cylindrical case 14*a* presses a higher portion of the inclined face 15*g* on the face on the downstream side of the valve body 15*c* of the first valve 15.

That is, the bottom portion 14*b* of the bottomed cylindrical case 14*a* presses a portion of the valve body 15*c* corresponding to the outside of the valve seat 11*c*.

Thereby, this valve body 15*c* is inclined against a biasing force of a spring, not shown.

Then, as shown in FIG. 12(B), a gap occurs between the valve body 15*c* and the valve seat 11*c* of the first valve 15, the first valve 15 is opened, and air is discharged into a container, not shown, via the second flow channel 11*d* and the first flow channel 11*a*.

Further, when the finger is released from the trigger 12, as shown in FIG. 12(A), an original state, namely, a state in which the valve body 15*c* has abutted on the valve seat 11*c* according to a restorative force of a spring, not shown, is restored so that the first valve 15 is closed.

The first to fourth variations of the trigger type sprayer 10 according to the embodiment of the present invention also have a similar advantageous effect to the trigger type sprayer 10 according to the embodiment of the present invention.

As described above, a preferred embodiment of the present invention has been described, but the present invention is not necessarily limited to such an embodiment.

For example, various shapes can be adopted as a shape of each component of the trigger type sprayer 10 as long as an opening and closing principle of the first valve of the present invention can be applied to the shapes.

INDUSTRIAL APPLICABILITY

The trigger type sprayer of the present invention has such a merit that air vent in a space between the second valve and the first valve can be easily performed.

The present invention can be applied not only to a trigger type pump dispenser but also to a push-type pump dispenser.

REFERENCE SIGNS LIST

10 . . . trigger type sprayer,
11 . . . body,
11*a* . . . first flow channel,
11*b* . . . cylinder chamber,
11*c* . . . valve seat of first valve,
11*d* . . . second flow channel,
11*e* . . . secondary cylinder chamber,
11*f* . . . air flow channel,
12 . . . trigger,
12*a* . . . return plate spring,
12*b* . . . fitting portion,
12*c* . . . hinge portion,
13 . . . hollow piston,
13*a* . . . negative pressure relief piston,
13*b* . . . valve seat of second valve,
13*c* . . . pair of supporting shaft,
13*d* . . . hollow portion,
14 . . . second valve,
14*a* . . . bottomed cylindrical case,
14*b* . . . bottom portion of bottomed cylindrical case,
14*c* . . . valve body of second valve,
14*d* . . . spring biasing valve body,
14*e* . . . abutting portion abutting on bottom portion,
14*f* . . . inclined face of bottom portion of bottomed cylindrical case,
14*g* . . . protrusion of bottom portion of bottomed cylindrical case,
14*h* . . . cam portion of bottom portion of bottomed cylindrical case,
14*j* . . . hollow portion of bottomed cylindrical case,
15 . . . first valve,
15*a* . . . cylindrical case,
15*b* . . . a plurality of axial grooves formed in an inner face of cylindrical case,
15*c* . . . valve body of first valve,
15*d* . . . a plurality of plate spring portions biasing valve body,
15*e* . . . lever attached to valve body of first valve,
15*f* . . . cam portion provided on lever,
15*g* . . . inclined face of valve body of first valve,
16 . . . nozzle,
16*a* . . . nozzle cover,
17 . . . cover of body,
18 . . . cap,
19 . . . suction tube.

The invention claimed is:

1. A trigger type sprayer comprising:

a body having a first flow channel through which liquid can flow, a second flow channel communicating with the first flow channel, and a cylindrical cylinder chamber communicating with the second flow channel;

a hollow piston slidably incorporated into the cylinder chamber, having a valve seat and a hollow portion, and sliding back and forth according to operation of a trigger;

a second valve incorporated into the hollow portion of the hollow piston and positioned at a downstream side; and a first valve incorporated into the cylinder chamber and positioned at an upstream side, wherein the second valve has a pressure accumulation function, and is provided with a valve body, a spring, and a bottomed cylindrical case housing the valve body and the spring and attached inside the hollow portion, the first valve is provided with a cylindrical case, a downstream side of which is opened and an upstream side of which is attached in the cylinder chamber, and a valve body positioned at the upstream side of the cylindrical case, the bottomed cylindrical case is slidably incorporated into the cylindrical case, and slides back and forth together with the hollow piston according to operation of the trigger, and the valve body of the first valve is pressed and inclined by a bottom portion of the bottomed cylindrical case so that the first valve is opened.

2. The trigger type sprayer according to claim 1, wherein an inclined face is formed on a face on a downstream side of the valve body of the first valve.

3. The trigger type sprayer according to claim 1, wherein an inclined face is formed on a face on an upstream side of the bottom portion of the bottomed cylindrical case of the second valve.

4. The trigger type sprayer according to claim 1, wherein a protrusion is formed on a face on an upstream side of the bottom portion of the bottomed cylindrical case of the second valve.

5. The trigger type sprayer according to claim 1, wherein a cam portion is formed on a face on an upstream side of the bottom portion of the bottomed cylindrical case of the second valve, and a lever provided with a cam portion is attached to a side of the valve body of the first valve so as to extend downstream.

6. The trigger type sprayer according to claim 1, wherein the second valve is of a direct pressure type having no pressure accumulation function.

* * * * *